US011035654B2

(12) United States Patent
McLaren et al.

(10) Patent No.: US 11,035,654 B2
(45) Date of Patent: Jun. 15, 2021

(54) ENHANCED PERFORMANCE AMMUNITION

(71) Applicant: BAE SYSTEMS plc, London (GB)

(72) Inventors: Lawrence Neil McLaren, Crewe (GB); Simon France Parker, Crewe (GB)

(73) Assignee: BAE SYSTEMS PLC, London (GB)

( * ) Notice: Subject to any disclaimer, the term of this patent is extended or adjusted under 35 U.S.C. 154(b) by 0 days.

(21) Appl. No.: 16/652,143

(22) PCT Filed: Oct. 1, 2018

(86) PCT No.: PCT/GB2018/052796
§ 371 (c)(1),
(2) Date: Mar. 30, 2020

(87) PCT Pub. No.: WO2019/069064
PCT Pub. Date: Apr. 11, 2019

(65) Prior Publication Data

US 2020/0248997 A1 Aug. 6, 2020

(30) Foreign Application Priority Data

Oct. 3, 2017 (EP) ..... 17275156
Oct. 3, 2017 (GB) ..... 1716111

(51) Int. Cl.
*F42B 14/02* (2006.01)
*F42B 12/78* (2006.01)
(Continued)

(52) U.S. Cl.
CPC ..... *F42B 14/02* (2013.01); *F42B 12/74* (2013.01); *F42B 12/78* (2013.01); *F41A 21/18* (2013.01)

(58) Field of Classification Search
CPC ..... F42B 12/74; F42B 12/78; F42B 14/02
(Continued)

(56) References Cited

U.S. PATENT DOCUMENTS 847,149 A * 3/1907 Barlow ..... F42B 14/02 102/524
2,759,421 A * 8/1956 Sublette ..... F42B 14/02 102/526

(Continued)

FOREIGN PATENT DOCUMENTS

DE 29516889 U1 10/1995
WO 2007022612 A1 3/2007

(Continued)

OTHER PUBLICATIONS

International Search Report and Written Opinion received for PCT Application No. PCT/GB2018/052796. dated Dec. 6, 2018. 13 pages.

(Continued)

*Primary Examiner* — Bret Hayes
(74) *Attorney, Agent, or Firm* — Finch & Maloney PLLC

(57) ABSTRACT

This invention relates to a combination of a gun having a rifled barrel and a round of enhanced performance ammunition, and to a projectile for use in the combination. The invention is especially, but not exclusively related to an improved form of projectile for small arms ammunition. There is provided a projectile with a nominal calibre, for use in a rifled barrel, the projectile comprising: a monolithic body, said monolithic body comprising a. an ogival portion forming the front of the monolithic body; said ogival portion at a point of intersection abuts with
b. an elongate cylindrical core, said elongate cylindrical core comprising at least three bands located circumferentially thereon, said bands protruding radially outward therefrom; and said elongate cylindrical core abuts
c. a boat tailed portion, forming the rear of the monolithic body, wherein a first band is located at the point where the elongate cylindrical core abuts the boat tail section, (Continued)

Figure 1:
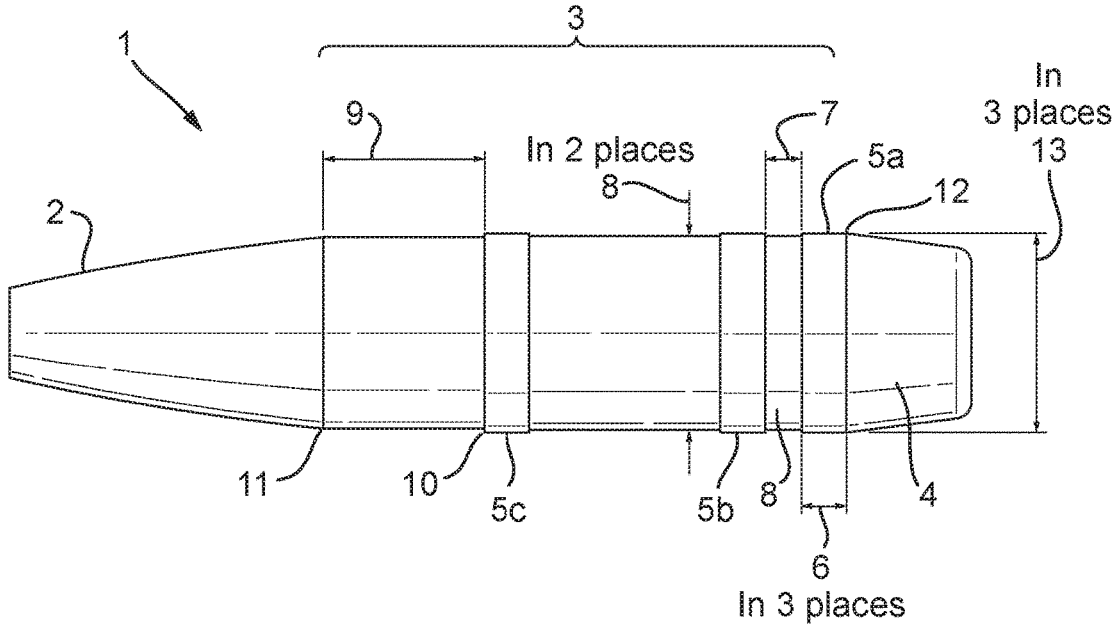

wherein a third band is located rearwardly, from the point of intersection, at a distance in the range of from 80% to 120% of said nominal calibre, wherein a second band is located between the first and third bands on said elongate cylindrical core;

wherein the monolithic body is formed from a metal having a Vickers Hardness of at least 550 HV, wherein a deformable jacket or coating, surrounds the monolithic body, which defines an outer diameter of said projectile.

20 Claims, 2 Drawing Sheets

(51) Int. Cl.
*F42B 12/74* (2006.01)
*F41A 21/18* (2006.01)

(58) Field of Classification Search
USPC ..... 102/524, 526
See application file for complete search history.

(56) References Cited

U.S. PATENT DOCUMENTS 3,154,016 A * 10/1964 Frey ..... F42B 14/02 102/501
5,686,693 A 11/1997 Jakobsson
D456,480 S * 4/2002 Quinsa ..... F42B 14/02 102/508
9,335,230 B1 * 5/2016 Hooke ..... F42B 14/02
2004/0244630 A1 * 12/2004 Booth ..... F42B 12/74 102/517
2014/0373746 A1 12/2014 Marx
2016/0153757 A1 6/2016 Mahnke
2016/0252332 A1 * 9/2016 Gelfert ..... F42B 5/067 102/464
2016/0327380 A1 * 11/2016 Kunz ..... F42B 10/44
2017/0115104 A1 * 4/2017 Peterson ..... F42B 14/02
2017/0138709 A1 * 5/2017 Oberholster ..... F42B 14/02
2018/0094911 A1 * 4/2018 Fournier ..... F42B 12/74

FOREIGN PATENT DOCUMENTS

WO 2015059282 A1 4/2015
WO 2019069064 A1 4/2019

OTHER PUBLICATIONS

GB Search Report under Section 17(5) received for GB Application No. 1716111.8 dated Feb. 26, 2018. 3 pages.
Extended European Search Report received for EP Application No. 17275156.2, dated Feb. 16, 2018. 8 pages.
International Preliminary Report on Patentability received for PCT Application No. PCT/GB2018/052796. dated Apr. 16, 2020. 7 pages.

* cited by examiner

ENHANCED PERFORMANCE AMMUNITION

This invention relates to a combination of a gun having a rifled barrel and a round of enhanced performance ammunition, and to a projectile for use in the combination. The invention is especially, but not exclusively related to an improved form of projectile for small arms ammunition.

When a projectile is fired from a rifled barrel, the projectile must deform as it travels along the barrel so that material forming part of the projectile is forced into the spaces between the lands that form the rifling. This process is called engraving, and causes a spin to be imparted to the projectile by virtue of the twist of the rifling.

The deformation of the projectile, its travel along the barrel effectively as a force fit to the rifling, the high linear acceleration imparted by the gun propellant on firing, and the consequent high rate of angular acceleration and associated force acting between rifling and projectile all contribute to substantial wear on the barrel.

If this wear rate can be reduced, substantial benefits follow, including increased barrel life, higher muzzle velocity and hence increased accuracy and lethality.

For this reason, low friction, soft, readily deformable materials are normally selected for small arms bullet. This was originally achieved by the use of solid lead bullets but these have now been almost universally replaced by a bullet comprising of a gilding metal jacket and lead core.

In order to improve bullet penetrative performance and/or to have a lead free bullet, it is necessary to use other materials such as for example steel. However, steel is not readily deformable, and when a solid steel core is used it can cause unacceptable barrel wear. On the other hand, hardness is a very desirable characteristic for the bullet material, in order to minimise nose tip ablation during penetration of hardened targets such as, for example, titanium/kevlar body armour.

In seeking to overcome these problems whilst striving to improve penetrative performance, it has been common practice to make a small arms bullet from a steel tip used in combination with a rearwardly located lead core enclosed in a gilding metal jacket. This provides the advantage of cheap construction, but still provides for a substantial amount of lead. The problem here is that when the projectile strikes a target at an oblique angle, the steel tip and lead core follow different trajectories, thus the penetrative performance improvement is limited.

According to the present invention there is provided a projectile with a nominal calibre, for use in a rifled barrel, the projectile comprising: a monolithic body, said monolithic body comprising a. an ogival portion forming the front of the monolithic body; said ogival portion at a point of intersection abuts with b. an elongate cylindrical core, said elongate cylindrical core comprising at least three bands located circumferentially thereon, said bands protruding radially outward therefrom; and said elongate cylindrical core abuts c. a boat tailed portion, forming the rear of the monolithic body, wherein a first band is located at the point where the elongate cylindrical core abuts the boat tail section, wherein a third band is located rearwardly, from the point of intersection, at a distance in the range of from 80% to 120% of said nominal calibre, wherein a second band is located between the first and third bands on said elongate cylindrical core;

wherein the monolithic body is formed from a metal having a Vickers Hardness of at least 550 HV, wherein a deformable jacket or coating, surrounds the monolithic body, which defines an outer diameter of said projectile.

The at least three bands may each have a width in the range of from 17% to 23% of the nominal calibre of the projectile. For a 5.56 mm round, the nominal width of the band is in the highly preferred range of from 0.85 to 1.15 mm, preferably 0.95 mm to 1.05 mm, preferably nominally 1 mm. Preferably all three bands have substantially the same width.

The at least three bands, in a preferred arrangement may protrude above the elongate cylindrical core at a height in the range of from 0.5% to 4% of the nominal calibre of the projectile, more preferably in the range of from 1.5% to 2.5% of the nominal calibre. The bands have a leading edge towards the ogival section and a rear edge, located towards the boat tail section.

The third band is located rearwardly of the ogival section, at a distance from the point of intersection, in the range of from 80% to 120%, more preferably, 85% to 100%, more preferably 85% to 95% of the nominal calibre of the projectile. The distance is measured from the leading edge of the third band to the point of intersection. Preferably the distance from the leading edge of the third band to the point of intersection is less than the nominal calibre of the munition. The elongate cylindrical core has substantially parallel sides, and the point of intersection is the point where the sides of the elongate cylindrical core are substantially first parallel.

The second band is located between the first and third bands. In a preferred arrangement the second band is proximate to the first band towards the rear of the monolithic body, preferably at a distance from the third band in the range of from 17% to 23% of the nominal calibre of the projectile, most preferably for a 5.56 mm round the distance between the second band and third band is substantially a width of a band.

The material selected for the projectile monolithic body will depend partly upon the function which the projectile is to perform, but in the case of enhanced performance ammunition may be greater than a Vickers Hardness of 550 HV, more preferably greater than 570 HV.

The projectile body may be made from any material which has a high Vickers Hardness, such as metals, ceramics, carbides, and borides. The metals may be selected from steel, tungsten, alloys of tungsten. Carbides may be selected from tungsten carbide. Preferably hardened steel.

The deformable jacket or coating, surrounds the monolithic body, which defines an outer diameter of said projectile.

The coating may be an electrodeposited coating, however the deposition techniques are designed to provide a metal which closely aligns to the monolithic body, and therefore removes the small cavities which exist between the ogival portion and the leading edge of the third band when a jacket is used. The advantage of the deposited coating is that it provides better transfer of spin from the outer metal coating to the monolithic body.

The deformable jacket may typically be a gilding metal jacket, typically copper or alloys thereof. The jacket may comprise, a metal jacket, formed from an extrudable outer sheath which is pressed through a series of dies, and forms around the monolithic body. In a highly preferred arrangement the jacket is located over the monolithic body, such that there are cavities created between the jacket and the monolithic body. The jacket may touch the monolithic body at the point of intersection and the leading edge of the third band, thereby creating a cavity under the jacket. Further there is a cavity created between the jacket and the monolithic body as there is only contact at the rear edge of the first band and the leading edge of the second band. There is a yet further cavity created between the jacket and the monolithic body as there is only contact at the rear edge of the second band and the leading edge of the third band.

The outer diameter of said projectile is substantially equal to an internal diameter of the barrel defined by the lands, and wherein during firing of the projectile the lands of the rifling in the barrel deform the deformable jacket or coating into the grooves defined between the at least three bands on the elongate cylindrical core of the body, and between the point of intersection and the leading edge of the third band.

Upon firing, deformation of the jacket is designed to provide the projectile with an interference fit with the rifling lands rifling so as to provide effective obturation by restricting or preventing the escape of propellant gases past the projectile via the rifling grooves.

According to a further aspect of the invention there is provided a combination of a gun having a rifled barrel and a round of ammunition as defined herein, the rifling of the barrel comprising rifling grooves which are separated by lands extending helically along a length of the barrel; the projectile having an outer diameter substantially equal to or less than an internal diameter of the barrel defined by the lands, and wherein during firing of the projectile the deformable jacket is deformed by the lands of the barrel into the grooves formed between the at least three bands and point of intersection on the elongate core.

The combination provides an arrangement such that wherein upon firing deformation of the jacket or coating provides the projectile with an interference fit with the rifling lands rifling so as to provide effective obturation by restricting or preventing the escape of propellant gases past the projectile via the rifling grooves.

Normally, the projectile will also have an ogival nose portion of the body forward of said substantially elongate cylindrical core, although other forms are possible.

The body of the projectile (i.e. excluding the deformable jacket) should have a diameter which is not greater than that defined by the rifling lands. The deformable jacket or deposited coating, of the projectile has an outer diameter which is designed so that upon firing of the projectile the rifling lands engage the deformable jacket which is designed to deform into the groove air gaps between said at least three bands and the point of intersection. The engagement of the deformable jacket with the rifling lands induces spin in the projectile due to the twist of the rifling. This deformation gives the projectile an interference fit with the rifling so as also to provide effective obturation by restricting or preventing the escape of propellant gases past the projectile via the rifling grooves. The length and precise diameter of the projectile is designed to provide the best fit.

Regard must also be taken to ensure that the force required to effect the deformation of the jacket material and to propel the projectile along the barrel is not excessive, and therefore the diameter of the monolithic body may not be greater than that of the rifling lands. This force is substantially reduced by the presence of the air gaps between the at least three bands and the deformable jacket, and between the point of intersection and the leading edge of the third band, to deform into said groove air gaps during the passage of the monolithic body along the barrel.

In high volume conditions, steel is a suitable material, as it is inexpensive and can be readily formed into the desired shape, eg. by a cold-forming process.

Results

The enhanced performance round according to the invention was compared to a NATO standard round, the SS109 bullet as employed in 5.56 mm Ball (NATO) ammo. The rounds were fired using the same propellant and from the same length barrel on a test rig.

EP* round according to the invention

Hardened steel core 570 HV, nominal 5.56 mm calibre. Distance from point of intersection to leading edge of third band 4.85 mm. Band height 0.125 mm, distance between second band and first band 1.0 mm, mass of monolithic body 2.3 g.

TABLE 1

| Target | Increase in range at which target can be defeated by EP* over std SS109 |
|---|---|
| 3.5 mm Steel (NATO plate) | 46% |
| 8 mm Steel | 31% |
| 5 mm Armour Plate | 140% |
| Simulated Protected Light Truck | SS109-no capability; EP*-short range capability |

It is clear from the data in table 1 that the improvements in target defeat, without comprise of accuracy, provide a significant improvement on a conventional NATO round, when fired under the same test conditions.

The use of a monolithic body, with a high Vickers Hardness provides improved penetration and defeat, the use of narrow ranges of locations of the at least three bands and point of intersection, provides the outer jacket the ability to deform into the grooves located between the said at least three bands and point of intersection; to ensure both a gas tight seal and sufficient thickness to prevent the rifling bands impinging on the monolithic body The invention is particularly but not exclusively applicable to small arms weapons systems, having a nominal calibre of 20 mm or less, such as for example, 12.7 mm, 9 mm or less, such as 7.62 mm, 5.56 mm and 4.6 mm.

The invention will now be described by way of example only with reference to the accompanying drawings, of which:—

Figure 2:
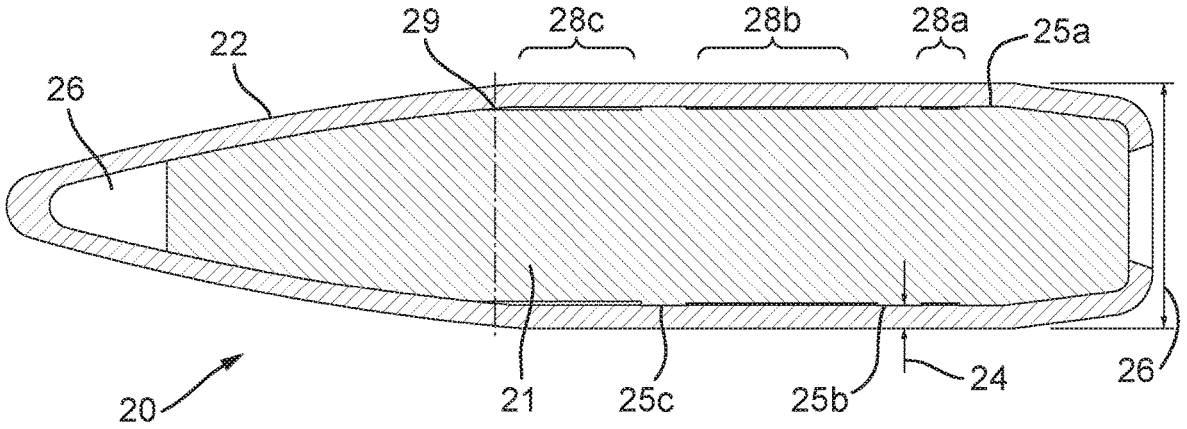
Figure 2A:
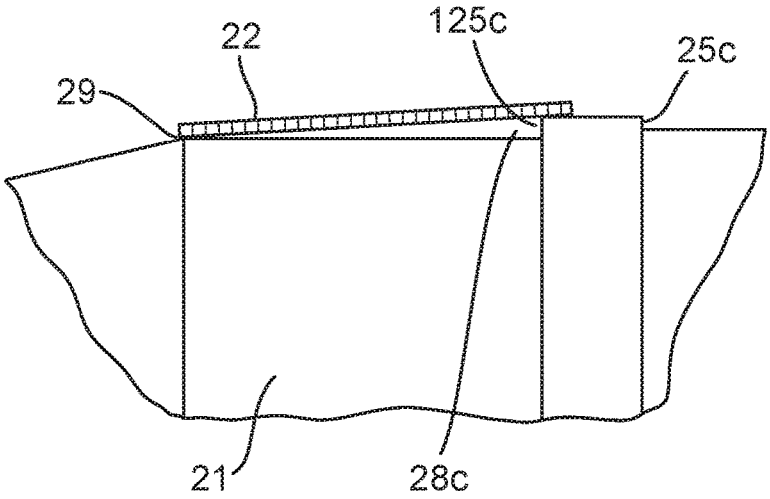
Figure 3:
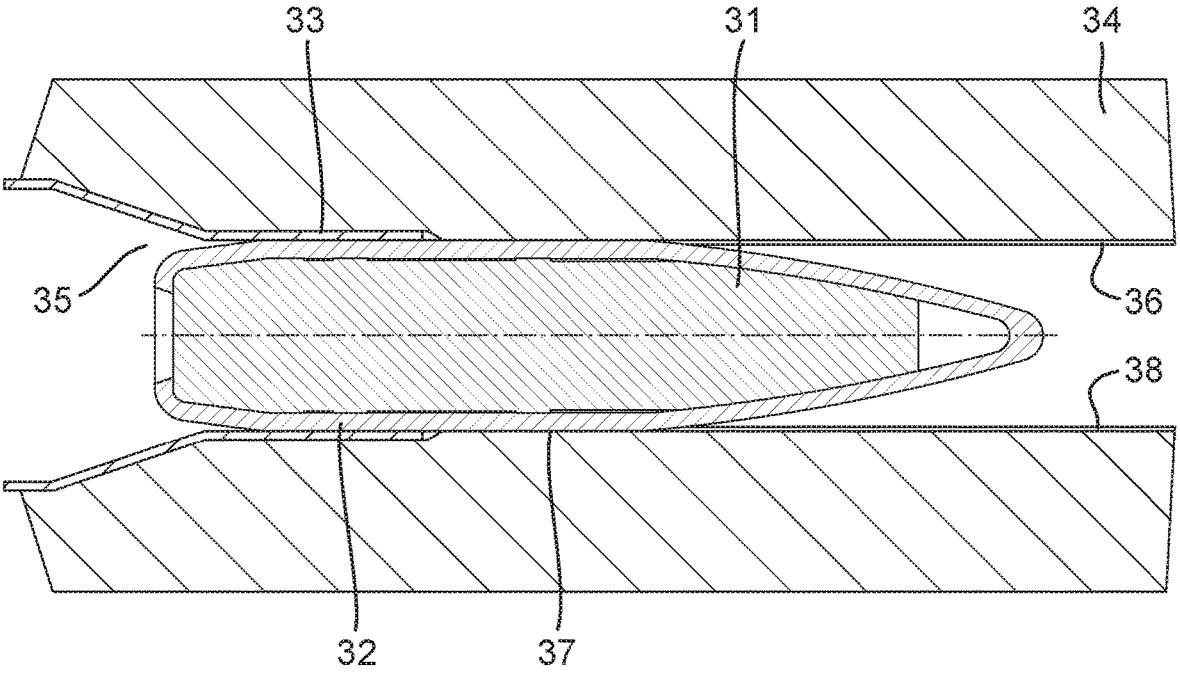

FIG. 1 shows a diagrammatic representation of a monolithic body incorporating at least three bands; and FIGS. 2 and 2*a* show the projectile shown in FIG. 1, with a jacket thereon FIG. 3 shows, in section, the monolithic body and part of the cartridge case located in the chamber of a gun having a rifled barrel and ready for firing.

As shown in FIG. 1, a small arms monolithic body 1 comprising an elongate cylindrical core 3, an ogival portion 2, and a rearwardly located boat tailed portion 4.

Along the length of the elongate cylindrical core 3, are located at least three bands (5*a*, 5*b* and 5*c*), between which are created grooves 8.

The ogival portion 2 abuts the elongate cylindrical core 3, at the point of intersection 11. The point of intersection 11 is the point where the elongate cylindrical core has substantially parallel sides. The third band 5*c*, is located rearwardly, from the point of intersection 11, at a distance 9 in the range of from 80% to 120% of said nominal calibre. The distance 9 is nominally taken from the leading edge 10 to the point of intersection 11.

The boat tail section 4 abuts the elongate cylindrical core 3, at the rear edge 12 of the first band 5*a*.

The second band 5*b* is located between the first band 5*a* and third band 5*c*. The gap 7 between the first band 5*a* and second band 5*b*, is preferably less than the gap between the second band 5*b* and the third band 5*c*, more preferably the gap 7 is substantially the same as one width of a band 6.

The bands are preferably all the same width 6, and protrude radially outwards a height 13. Preferably the at least three bands are uniform in their width and height.

The monolithic body 1 is of elongate form and may preferably be cold formed from steel having a Vickers Hardness of at least 550, more preferably 570 HV. It can subsequently be given a heat treatment to provide the desired hardness or other physical properties.

Because of the substantial hardness of the monolithic body material, the projectile is highly effective at penetration of targets such as titanium/kevlar body armour. Moreover, the hardness also serves to minimise ablation of the projectile tip profile, thus further contributing to its effectiveness in target penetration.

FIG. 2 show the projectile 20 which comprises the monolithic body 21 (as exemplified in FIG. 1), with a jacket 22, located thereon. The leading edge 125*c* of the third band 25*c* (see FIG. 2*a*) and the point of intersection 29 form two contact points, such that when the jacket is applied it forms a cavity 28*c*. Further the at least three bands 25*a*, 25*b* and 25*c*, provide grooves 28*b* and 28*c*, such that when the jacket 22 is compressed when it impacts on the rifling of the barrel (FIG. 3), the copper jacket 22 deforms into the grooves 28*a*, 28*b* and 28*c*. The jacket 22 has a thickness 24, selected to provide the desired outer diameter for the nominal calibre of the gun form which it is to be fired.

When the monolithic body 21 and deformable jacket 22 passes from the gun chamber into the rifled part of the barrel, by virtue of its outer diameter 26, the jacket 22 is deformed by the lands of a rifled barrel into the corresponding groove air gaps 28*a*, 28*b* and 28*c* corresponding to the at least three band 25*a*, 25*b*, 25*c* and point of intersection 29. The outer diameter 26 of the jacket material 22 should be substantially equal to the diameter of any rifling grooves (not shown).

The presence of the grooves 28*a*, 28*b*, 28*c* facilitates the necessary deformation of the jacket 22, thus enabling the rifle engraving to take place with a substantially reduced axial force. The fact that the jacket material can deform into the grooves contributes considerably to a dramatic reduction in the axial force required for engraving to occur.

Preferably the monolithic body 21, is covered by a jacket, which is extruded over the monolithic body, and creates a cavity 26.

Therefore, despite the hardness of the monolithic body, barrel wear from this factor is minimised.

It will be evident to the skilled addressee that all of these factors reducing the engraving force will also result in reduced barrel wear, higher muzzle velocity, and hence increased lethality and accuracy.

The optimum design parameters for the projectile according to the invention can be determined by those skilled in the art, based on the teaching contained herein.

The invention is particularly but not exclusively applicable to small arms ammunition. In one particular example, the invention has been successfully applied to 5.56 mm gun and ammunition.

As shown in FIG. 3, in use the round of ammunition comprising the assembled primed and filled cartridge case 33, together with a projectile 31 are fired from a gun having a rifled barrel 34, in the conventional manner, i.e. by chambering the round within the gun chamber 35, and arranging for the primer cap (not shown) to be struck by a firing pin.

When the monolithic body 21 and associated jacket 22 passes from the gun chamber into the rifled part of the barrel, by virtue of its greater diameter, the monolithic body becomes engraved by the rifling 37. The diameter of the monolithic body 21 and associated jacket 22 should preferably be substantially equal to or less than the diameter of the rifling grooves 38, while the grooves 32 (which are formed between the bands 25(*a*-*c*) and point of intersection, can have substantially the same diameter as the barrel diameter.

The presence of the grooves 32 facilitates the necessary deformation of the jacket 22, thus enabling the engraving to take place with a substantially reduced axial force. The fact that the jacket 22 can deform into the grooves 32 contributes considerably to a dramatic reduction in the axial force required for engraving to occur.

The jacket 22 is of a malleable material which can be copper or a copper alloy and could additionally comprise an outer layer of a low-friction material such as molybdenum disulphide. This jacket 22 is of a thickness greater than the depth of the rifling grooves, and is of a relatively softer material than that of the monolithic body 21, it can also engrave more readily, and thus contribute for this reason also to a reduction in the engraving force required. Because the jacket 22 is thicker than the depth of rifling, engraving can take place entirely within the coating so that the hard metal of the monolithic body 21 is kept substantially out of contact with the material forming the rifling of the gun barrel. Therefore, despite the hardness of the material forming the main part of the monolithic body 21, barrel wear from this factor is minimised.

The invention claimed is:

1. A projectile with a nominal calibre, for use in a rifled barrel, the projectile comprising:

a monolithic body comprising a metal having a Vickers Hardness of at least 550HV, said monolithic body including a boat tailed portion, forming the rear of the monolithic body, an elongate cylindrical core, said elongate cylindrical core abuts said boat tailed portion and comprises at least three bands located circumferentially thereon, said bands protruding radially outward therefrom, and an ogival portion, said ogival portion at a point of intersection abuts with said elongate cylindrical core, forming the front of the monolithic body, wherein a first band of the at least three bands is located at the point where the elongate cylindrical core abuts the boat tailed portion, wherein a third band of the at least three bands is located rearwardly, from the point of intersection, at a distance in the range of from 80% to 120% of said nominal calibre, wherein the third band is a forward-most band of the at least three bands, and wherein a second band of the at least three bands is located between the first band and the third band on said elongate cylindrical core; and a deformable jacket or coating, surrounding the monolithic body, which defines an outer diameter of said projectile.

2. The projectile according to claim 1, wherein each of said first band, second band, and third band protrudes radially outward from the elongate cylindrical core a height in the range of from 0.5% and 4% of the nominal calibre of the projectile.

3. The projectile according to claim 1, wherein the monolithic body is made from one of steel, tungsten, alloys of tungsten, or tungsten carbide.

4. The projectile according to claim 1, wherein the third band is located at a distance from the point of intersection, in the range of from 85% to 95% of the nominal calibre of the projectile.

5. The projectile according to claim 1, wherein the projectile has a length that extends in a direction from said ogival portion to said boat tailed portion, and each of the first band, second band, and third band has a width, extending is said direction, in the range of from 17% to 23% of the nominal calibre of the projectile.

6. The projectile according to claim 1, wherein the second band is located a distance from the third band in the range of from 17% to 23% of the nominal calibre of the projectile.

7. The projectile according to claim 1, wherein said outer diameter of said projectile is substantially equal to an internal barrel diameter defined by a land of a rifled barrel, and wherein during firing of the projectile the land deforms the deformable jacket or coating into a cavity defined between the third band and the point of intersection.

8. The projectile as claimed in claim 7, wherein upon firing deformation of the deformable jacket or coating provides the projectile with an interference fit with the land so as to provide effective obturation by restricting or preventing the escape of propellant gases past the projectile via the cavity.

9. A combination of a gun having a rifled barrel and a round of ammunition according to claim 1; the barrel comprising rifling grooves which are separated by lands extending helically along a length of the barrel; the outer diameter of the projectile substantially equal to or less than an internal diameter of the barrel defined by the lands, and wherein during firing of the projectile the deformable jacket or coating is deformed by the lands of the barrel into cavities formed between the at least three bands and the point of intersection on the elongate core.

10. The combination according to claim 9, wherein upon firing deformation of the deformable jacket or coating provides the projectile with an interference fit with the lands so as to provide effective obturation by restricting or preventing the escape of propellant gases past the projectile via the rifling grooves.

11. A projectile with a nominal calibre, for use in a rifled barrel, the projectile comprising:

a monolithic body including a boat tailed portion, forming the rear of the monolithic body, an elongate cylindrical core that abuts said boat tailed portion and comprises at least three bands located circumferentially thereon, said bands protruding radially outward from said elongate cylindrical core, and an ogival portion that abuts with said elongate cylindrical core at a point of intersection, forming the front of the monolithic body, wherein a first band of the at least three bands is located proximate a location where the elongate cylindrical core abuts the boat tailed portion, wherein a third band is a forward-most band of the at least three bands and is located rearwardly, from the point of intersection, at a distance in the range of from 80% to 120% of said nominal calibre, and wherein a second band of the at least three bands is located between the first band and the third band; and a deformable jacket, surrounding the monolithic body, which defines an outer diameter of said projectile.

12. The projectile according to claim 11, wherein each of said first band, second band, and third band protrudes radially outward from the elongate cylindrical core a height in the range of from 1.5% to 2.5% of the nominal calibre of the projectile, and wherein the projectile has a length that extends in a direction from said ogival portion to said boat tailed portion, and each of the first band, second band, and third band has a width, extending is said direction, in the range of 0.85 mm to 1.15 mm.

13. The projectile according to claim 11, wherein the monolithic body is made from one of steel, tungsten, alloys of tungsten, or tungsten carbide.

14. The projectile according to claim 11, wherein the third band is located at a distance from the point of intersection, in the range of from 80% to 120% of said nominal calibre.

15. The projectile according to claim 11, wherein the second band is located a distance from the third band in the range of 0.85 mm to 1.15 mm.

16. A projectile with a nominal calibre, for use in a rifled barrel, the projectile comprising:

a monolithic body including a boat tailed portion, forming the rear of the monolithic body, an elongate cylindrical core that abuts said boat tailed portion and comprises at least three bands located circumferentially thereon, said bands protruding radially outward from said elongate cylindrical core, and an ogival portion that abuts with said elongate cylindrical core at a point of intersection, forming the front of the monolithic body, wherein a first band of the at least three bands is located proximate a location where the elongate cylindrical core abuts the boat tailed portion, wherein a third band is a forward-most band of the at least three bands and is located rearwardly, from the point of intersection, at a distance in the range of from 80% to 120% of said nominal calibre, and wherein a second band of the at least three bands is located between the first band and the third band; and a deformable jacket, surrounding the monolithic body, which defines an outer diameter of said projectile, wherein there are cavities between the jacket and the monolithic body.

17. The projectile according to claim 16, wherein each of said first band, second band, and third band protrudes radially outward from the elongate cylindrical core a height in the range of from 1.5% to 2.5% of the nominal calibre of the projectile, and wherein the projectile has a length that extends in a direction from said ogival portion to said boat tailed portion, and each of the first, second, and third bands has a width, extending is said direction, in the range of 0.85 mm to 1.15 mm.

18. The projectile according to claim 16, wherein the monolithic body is made from one of steel, tungsten, alloys of tungsten, or tungsten carbide.

19. The projectile according to claim 16, wherein the third band is located at a distance from the point of intersection, in the range of from 80% to 120 % of said nominal calibre, and the second band is located a distance from the third band in the range of 0.85 mm to 1.15 mm.

20. The projectile according to claim 16, wherein the cavities include a first cavity between the point of intersection and the third band, and a second cavity between the second and third bands, and wherein during firing of the projectile, barrel rifling deforms the deformable jacket into at least one of the first and second cavities.

* * * * *